United States Patent [19]

Deem

[11] 4,048,709

[45] Sept. 20, 1977

[54] METHOD OF CASTING

[75] Inventor: Howard H. Deem, Cincinnati, Ohio

[73] Assignee: Conval-Penn, Inc., McKeesport, Pa.

[21] Appl. No.: 733,201

[22] Filed: Oct. 18, 1976

[51] Int. Cl.[2] ..... B22C 9/02; B22D 47/02

[52] U.S. Cl. ..... 29/527.6; 164/4; 164/28; 164/30; 264/227

[58] Field of Search ..... 164/4, 6, 15, 28, 30; 264/227; 29/527.6

[56] References Cited

U.S. PATENT DOCUMENTS

| | | | |
|---|---|---|---|
| 1,663,455 | 3/1928 | Lukomski | 164/28 |
| 2,018,675 | 10/1935 | Hyde | 164/4 |

*Primary Examiner*—Robert D. Baldwin

*Attorney, Agent, or Firm*—Wood, Herron & Evans

[57] ABSTRACT

A method is disclosed for producing cast metal parts having smooth surfaces held to close dimensional tolerances, eliminating the need for machining. The method includes making a core box and pattern to closer tolerances than the finished part, producing a sample core and mold using sand of predetermined characteristics under regulated conditions. The sample core is precisely assembled with the sample mold and gauged. Thereafter, a prototype part is cast at a controlled temperature and cooled for a controlled time. The dimensions of the prototype part are compared with desired dimensions and the core box and pattern are modified where required. They are subsequently used to make production cores and molds formed from same sands under same conditions previously employed. The production cores and molds are accurately assembled and gauged and production parts cast at the same temperature previously used and are cooled as before.

6 Claims, 6 Drawing Figures

METHOD OF CASTING

BACKGROUND OF THE INVENTION

This invention relates to methods of casting and is particularly directed to a method of sand casting metal parts having smooth, flat surfaces to be held within close dimensional tolerances, e.g., tolerances of the order of 0.010 inches.

The present invention is particularly useful in casting large parts, for example, valve bodies, which may weigh as much as several hundred or even several thousand pounds. Many such valve bodies include various smooth surfaces which are intended to mate with other parts of the valve. These surfaces must be smooth and frequently must be held within close tolerances, for example, tolerances of the order of 0.010 inch.

In the past it has been customary to cast articles, such as the valve bodies described, without any attempt being made to cast the smooth, precisely-located surfaces. Rather, it was customary for the foundry to leave large excesses of metal in the areas where the surfaces were to be located so that the surfaces could be machined in a conventional way by turning, milling or the like. In addition to the inclusion of various machined surfaces, many past cast parts have other dimensional requirements. Thus, many such parts are intended for use under high pressure or other conditions in which the parts are subjected to substantial stresses so that certain wall thicknesses and the like must be above a critical dimension.

In conventional foundry practice, no effort has been made to closely regulate the thickness of cast walls. Rather, as a practical matter, foundries, made the wall thicknesses substantially thicker than necessary in order to make certain that even under adverse conditions the walls exceeded the required minimum thickness.

As a result of the lack of a method for precision sand casting large parts, the cost of castings were substantially increased by the inclusion of excess material both in areas where it was used to insure minimum wall thickness and in other areas where it was initially provided and subsequently machined away. Additionally, the cost of many parts was substantially increased by the intricate machining operations necessary to finish and precisely locate various surfaces on the part.

SUMMARY OF THE PRESENT INVENTION

It is a principal object of the present invention to provide a novel method of precision sand casting large metal parts. Utilizing the present method, smooth surfaces can be formed on the part while maintaining precise dimensions so that no subsequent machining is required on these surfaces. In short, the surfaces can be utilized just as they are cast without employing turning or other finishing operations.

Furthermore, the present invention makes it feasible to precisely control the thickness of wall areas and the like so that critical areas can be cast with dimensions only slightly above design dimensions with no substantial excess thickness of the type previously utilized.

One of the principal advantages of the present method is that it substantially reduces the cost of the finished casting by eliminating many of the machining operations previously required.

A second advantage of the present invention is that it further reduces the cost of cast parts by material savings due to the elimination of the excess material previously required to insure minimum wall thicknesses and in the elimination of excess material previously provided for machining.

A still further advantage of the present invention is that it reduces the inventory lead time since the parts produced in accordance with the method require substantially less time-consuming machining operations after they have been cast. Moreover, if desired, a larger inventory can be maintained since the parts held in inventory are less costly, reflecting the absence of a substantial amount of expensive machining time.

A still further advantage of the present invention is that the smooth precision surfaces cast in accordance with the present invention are in many respects superior to machined surfaces in that they tend to be more corrosive-resistant.

The method of the present invention is predicated upon the unexpected empirical discovery and determination that large metal parts can be cast in such a manner that smooth surfaces can be produced and close tolerances maintained to a degree not previously considered feasible. The present invention involves the initial steps of producing patterns and core boxes to very fine tolerances substantially less than the final permissible tolerances of the cast part. This is in complete opposition to the conventional foundry technique of permitting large tolerances in patterns and core boxes for sand castings since excess cast material was to be intentionally provided.

Following the production of the core boxes and patterns, sample sand cores and molds are produced. These sample cores are produced from sand of carefully controlled characteristics using carefully controlled cure temperatures and times. Likewise, the sand molds are produced from sand of carefully controlled characteristics under carefully controlled pressure and time conditions.

In the next step of the present method the sample cores and molds are assembled and gauged to provide an extremely accurate assembly, with the core precisely positioned with the mold.

Following this, a prototype part is cast by pouring metal under precise temperature control. This cast prototype is cooled in the mold and is subsequently checked dimensionally against the design dimensions of the finished part. Wherever excessive dimensional differences are observed, corresponding modifications are made in the patterns and core boxes.

The thus modified patterns and core boxes are then utilized to produce production sand molds and cores using sand of the same characteristics shaped under precisely the same conditions utilized to produce the sample molds and cores. Because of the precise production control over cores and molds, a high degree of uniformity is obtained from one core and mold to another. Again, in production, the cores and molds are carefully assembled and gauged to insure an accurate position of the core within the mold. Production cast parts are poured at the same temperatures previously utilized in casting the prototype part. After casting, the finished part is cooled as before and is removed from the mold, carefully hand-blasted and touchup grinding operations, if required, are performed.

I have determined that by utilizing this method even large complicated parts can be cast with smooth surfaces which require no machining positioned within 0.010 inch tolerances. Moreover, large walls may be cast with thickness held to within 1/16 inch tolerances.

As a consequence, the machining costs of parts can be reduced as much as 60% and the overall savings on parts, including material costs, can run on the order of 35% to 40%.

These and other objects and advantages of the present invention will be more readily apparent from a consideration of the following detailed description of one preferred example of the present process.

DESCRIPTION OF A PREFERRED EMBODIMENT

The present process of precision casting is useful in producing many different types of articles weighing from a few pounds to several thousand pounds. One example of the utility of the present process is in the casting of parts for steel valves, although it is to be expressly understood that the present method is also highly advantageous in the production of other types of articles having surfaces which must be located within close tolerances and which must present smooth surfaces.

In order to clarify the principles of the present invention, it will be described as applied to the casting of a specific product, i.e., the body of a breech-lock wedge-gate valve. These valves, intended for use under high temperature and pressure conditions, are quite sizable, ranging from a few hundred pounds to almost one-half ton in weight. Because of their size and the extensive machining previously required, these valves will demonstrate the dramatic cost savings provided by the present casting process. Again, it is to be emphasized that the disclosure of the process as applied to one specific valve part is merely exemplary and that the present casting method can also be advantageously employed to cast other parts of a breech-lock valve, such as the yoke structure, bonnet and disc. The method can also be used advantageously to cast parts for other types of valves, such as, for example, the bodies of butterfly valves.

Figure 1:
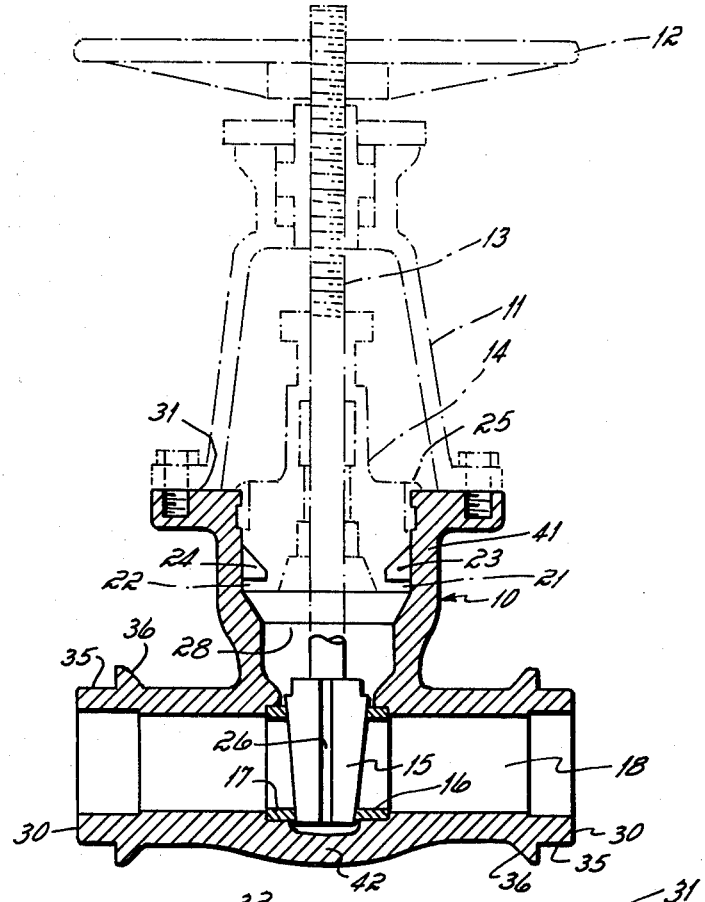
FIG. 1 is a vertical cross-sectional view of a valve body cast using the present method with the cooperating portions of the valve being shown in phantom.

Turning now to FIG. 1, there is shown in cross-section the body 10 of a breech-lock wedge-gate valve. Valves of this type are of conventional construction and the specific details of construction of the valve constitutes no part of the present invention. In addition to the body 10, the valve includes a yoke 11 which extends upwardly above the body and rotatably supports a handwheel 12 engaging a threaded rising stem 13. The stem passes downwardly through packing carried by a bonnet 14 and supports, at its lower end, a disc 15.

The disc 15 is adapted to seat against two seat rings 16 and 17 welded into valve body 10. As is well known to those skilled in the art, when the valve is in its closed position as shown in FIG. 1, the fluid passageway 18 through the valve body is blocked and sealed by the engagement of the disc with seats 16 and 17. Rotation of the handwheel 12 is effective to raise the stem and disc so that the disc is disengaged from the seats to permit flow through passageway 18.

Breech-lock valves of this type are adapted for heavy-duty service in power plants and other installations involving relatively high temperatures and substantial pressures, e.g., 900 to 5800 psi. In such a valve, the bonnet is securely locked in position within the body against the large forces involved by means of an interlocking lug arrangement. To this end the bonnet is provided with one or more sets of lugs spaced about the periphery of the bonnet. Two such lugs 21, 22 are shown in FIG. 1. It is to be understood that in actual practice at least four such lugs are utilized. These lugs on the bonnet pass downwardly through similar cooperating spaced lugs 23, 24 on the body when the bonnet is lowered into the body during assembly. Subsequently, the bonnet is rotated so that the bonnet lugs, such as lugs 21 and 22, are disposed beneath corresponding lugs, such as lugs 23 and 24, of the body. The bonnet is thus securely locked in position within the body. A final pressure-tight closure between the body and bonnet is provided by a small ring weld 25 laid between the periphery of the bonnet and adjacent flange portion of the body.

Figure 2:
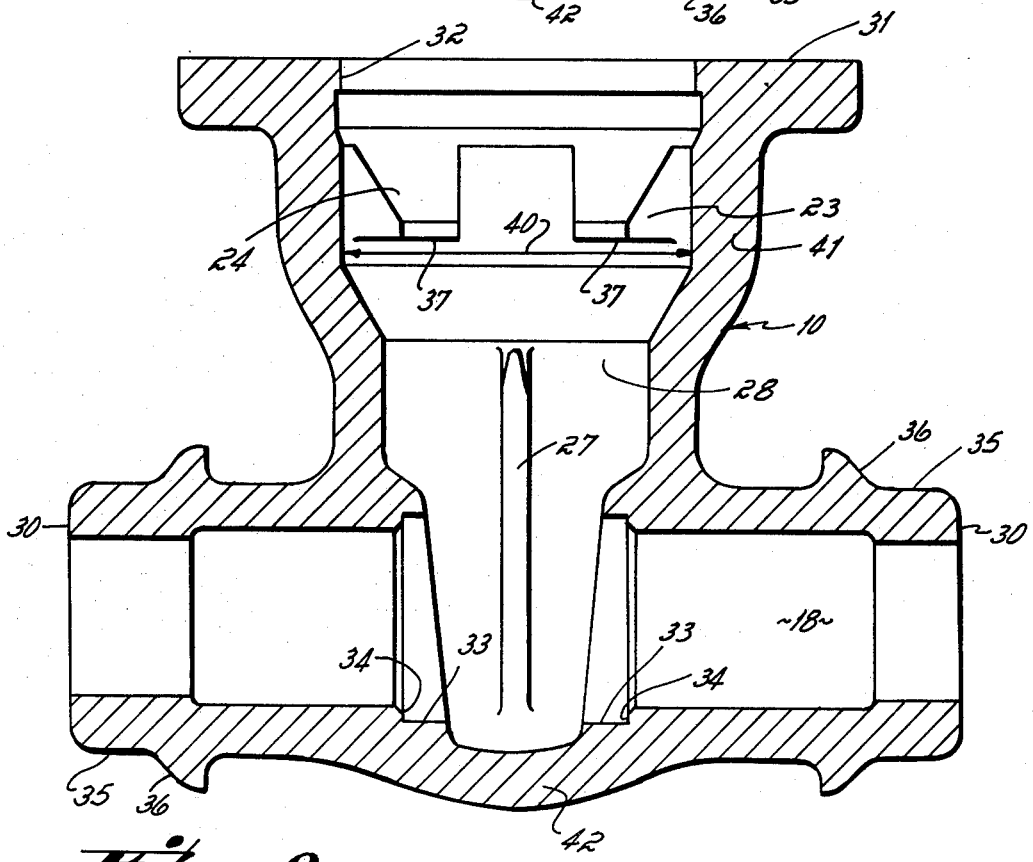
FIG. 2 is an enlarged vertical cross-sectional view of the valve body shown in FIG. 1.

As shown in FIGS. 1 and 2, the disc or gate member 15 is provided with vertical grooves 26 which receive guide ribs 27 formed in the body so that the disc is prevented from dragging across the seat rings.

In the past, it has been conventional manufacturing technique to cast valve bodies 10 leaving substantial excess material in the region which ultimately become the horizontal bore 18 and vertical chamber 28 of the valve body. Thereafter, it was conventional to machine various surfaces of the valve, including the outer ends 30 and upper flange 31 of the exterior of the valve body. In addition, the upper diameter 32 of vertical chamber 28 was machined as were all of the surfaces of the lugs, such as lugs 23 and 24. Also, the three exposed surfaces of guide ribs 27 were machined as were the peripheral and transverse shoulder surfaces 33 and 34 which support seat rings 16 and 17. In addition, the peripheral portions 35 at the end of the valve body and adjacent lug portions 36 were machined.

In contrast, when a valve body, such as valve body 10, is fabricated utilizing the present molding method, all machining is eliminated on the breech-lock lugs, such as lugs 23 and 24, as well as on ribs 27. In addition, no machining is required on seat-supporting surfaces 33 and 34 or on surfaces 35 and 36. These surfaces are precision cast so that they are located within the required dimensional tolerances and have the proper smooth surface characteristics without requiring any machining operation.

In addition, several other internal dimensions are held within those tolerances and wall thicknesses are closely controlled so that the substantial excess thickness previously provided is largely eliminated. The significance of this will be appreciated when it is considered that even a small valve of this type, e.g., a 4 inches valve, utilizes a body that is approximately 16 inches long by 13 inches high by 9 inches deep. Yet many dimensions of this body must be carefully controlled. For example, in one preferred form of valve, the lower surfaces 37 of lugs, such as lugs 23, 24, etc., must be located within a tolerance of plus or minus 0.010 inch from upper flange surface 31. The outer diameter of the space between the lugs indicated by dimension line 40 is maintained with a tolerance of plus zero, minus 1/16 inch. The distance between the respective inner faces of diametrically-opposed ribs 27 is held within a tolerance of minus zero to plus 1/16 inch. Moreover, certain wall thicknesses are critical. Thus, wall area 41 surrounding the bonnet and wall area 42 in the center of the body must be maintained at least 7/8 inch thick.

In addition to eliminating the machining operations previously required in the fabrication of valve body 10, the present casting method, because of its precision dimensional control, also made it feasible to substantially reduce the wall thickness of the valve body, for example, in the areas 41 and 42. In short, since the thickness of these walls could be accurately controlled within approximately 1/16 inch or so, it is unnecessary, as had previously been required, to provide a large, extra thickness as a safety factor.

In combination, the elimination of excess material previously incorporated to provide a safety factor, and the elimination of many of the previously-required machining operations, results in a total cost reduction in the production of a body member, such as body member 10, of the order of 35% to 40%.

The method of precision casting utilized to produce parts, such as the body 10 illustrated in FIGS. 1 and 2, can best be understood from a consideration of diagrams, FIG. 6 and FIGS. 3–5. More particularly, the first step in the process involves the making of a pattern. This pattern is produced from any suitable material, such as hard maple. In accordance with the present invention, the initial dimensions of the pattern are determined from a print of the final product using standard shrink rules of casting, e.g., a shrinkage of 1/8 inch per foot. Unlike conventional pattern-making techniques, the present patterns, at least in areas of critical dimensions, are made to an extremely close tolerance, such as 0.005 inch. This tolerance is substantially less than the smallest tolerance ultimately permitted in the finished part. When not in use, the present patterns are carefully handled and stored to prevent nicks and other incidental damage.

In the next step in carrying out the present process, a core box, preferably formed of metal, is machined to the same tolerances utilized in producing the pattern. Again, when not in use, the present core boxes are carefully protected to prevent damage of the type frequently encountered during handling and storage.

It is important in carrying out the present invention that not only the portions of the core box which actually define the main body of the core be held to close tolerances, but also close tolerances be maintained in the areas of the core box forming the core prints. Similarly, close tolerances are held not only on the main body of the mold, but also on the areas which form the recesses for the core prints. In fabricating body 10, these dimensions are held so that the ends of the core axis are supported within a tolerance of 1/32 inch from the corresponding axis of the mold cavity.

In the next step of the process a sample sand core, such as core 60, is formed using the core box. The shape of this core conforms to the shape of the inner walls of the valve body 10. Core 60 is formed from fine grain sand, preferably an AFS 80 sand. The sand preferably consists of a mixture of approximately two-thirds silica sand mixed with approximately one-third chromite. The sand is coated with a phenolic resin binder constituting approximately 4% of the total weight.

The sand is utilized to form a shell core using conventional shell core techniques. In a preferred embodiment, the core has a thickness of approximately ⅜ inch and is formed by blowing the sand into the core box at a pressure of 28 psi for approximately 4 seconds. The temperature of the core box is 425° on the ram side and 450° on the door side. The sand is held in the box for 60 seconds. Thereafter, the core box is inverted and rocked for 10 seconds to drain out uncured sand. The core box is then reinverted and the core is cured in the box for 90 seconds. After the core is removed from the box, any flashes are trimmed off. Thereafter, the core is coated with a suitable wash, for example, a magnesium oxide refractory wash of the type sold under the trademark Leeco M2 Air Set wash which utilizes a trichloroethane solvent. However, no coating is applied to the three core print areas 70, 71 and 72.

Turning now to the production of the body shown in FIG. 1, the next step of the procedure is to make a sample sand mold. The cope and drag sections of this mold are preferably formed using as a backup sand, a high-strength green molding sand. Suitable characteristics of such sand are that its moisture content is from 3.4 to 3.8%, its green strength is 14 to 17 pounds in compression, its compactability is from 44–48%. This backup sand is bonded with a bentonite clay binder having a moisture content of 3½%. The backup sand is coated with a facing sand having a thickness of 1½ inches to 2 inches. One preferred form of facing sand is an all new Manly sand of an 80 AFS grain size. The facing sand is bonded using bentonite clay binder having a 6% moisture content, and has a 6 to 8 pound green strength.

In forming the mold after the pattern has been positioned against the sand, the mold is jolted for 20 seconds. Thereafter, a squeeze head is brought against the pattern at a pressure of 90 psi, the pressure being maintained for approximately 10 seconds.

After the sand mold has been prepared, it is spray-coated with any suitable refractory wash, such as a magnesium oxide containing wash sold under the trademark Leeco M2 Air Set. The portions of the mold which engage the core prints are not coated.

Figure 3:
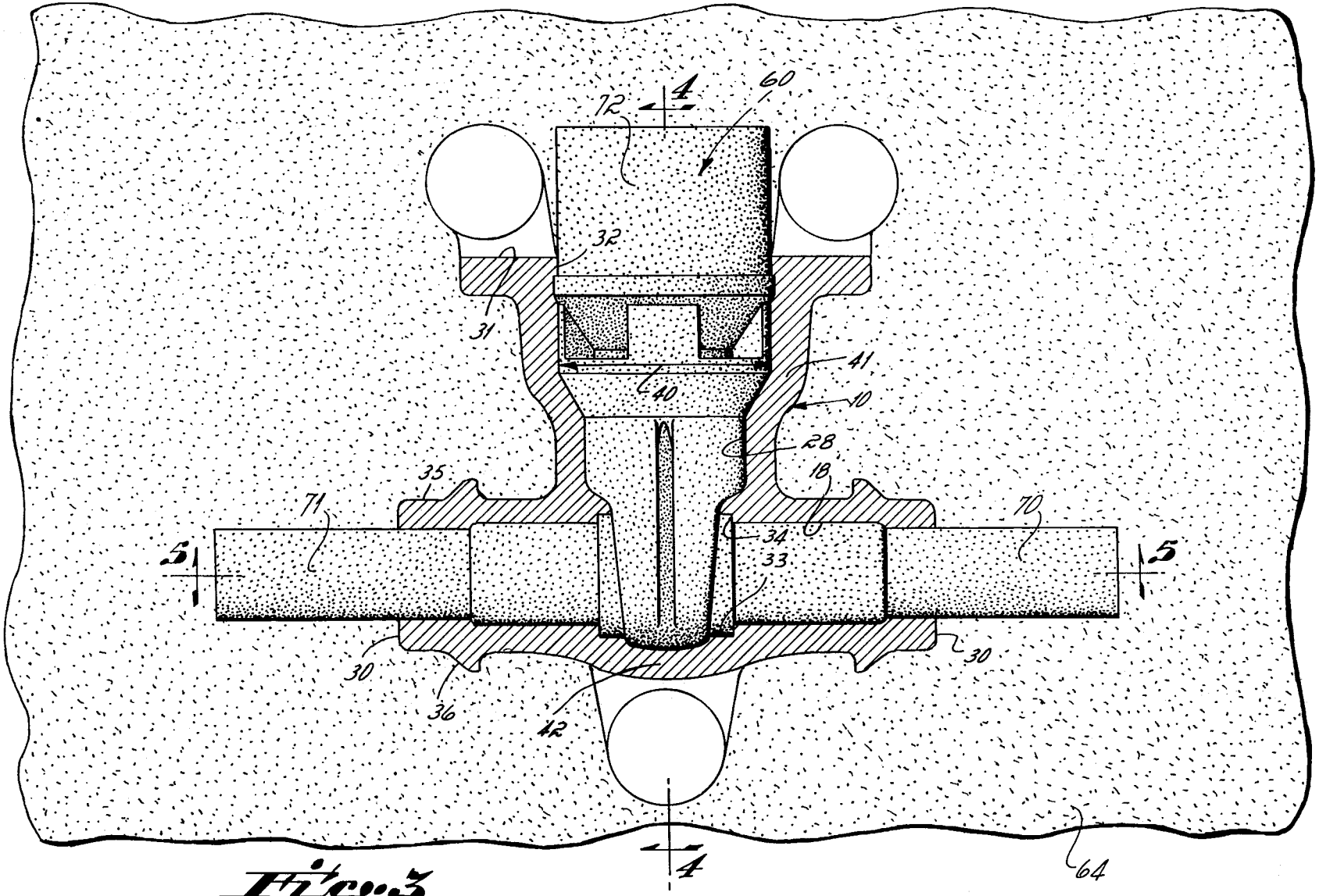
FIG. 3 is a top plan view showing the drag portion of the mold, with the core in place, and a cast valve body in section.
Figure 4:
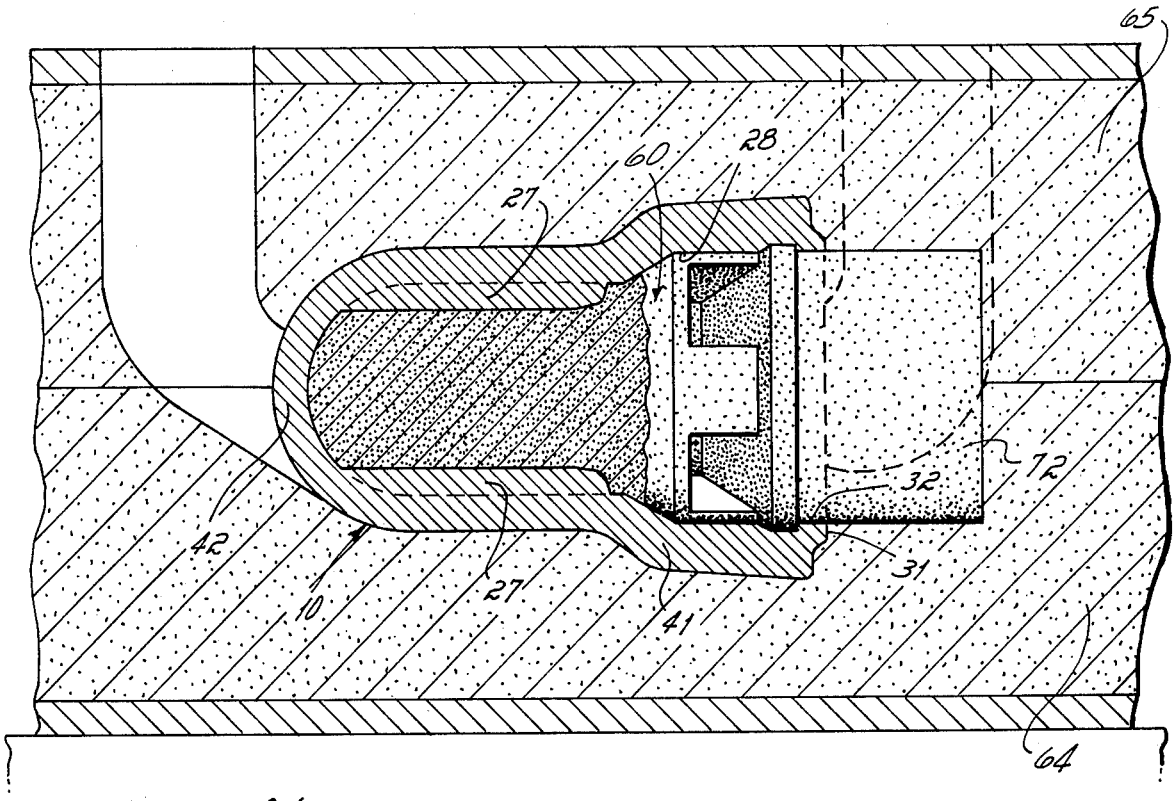
FIG. 4 is a cross-sectional view taken along line 4—4 of FIG. 3.
Figure 5:
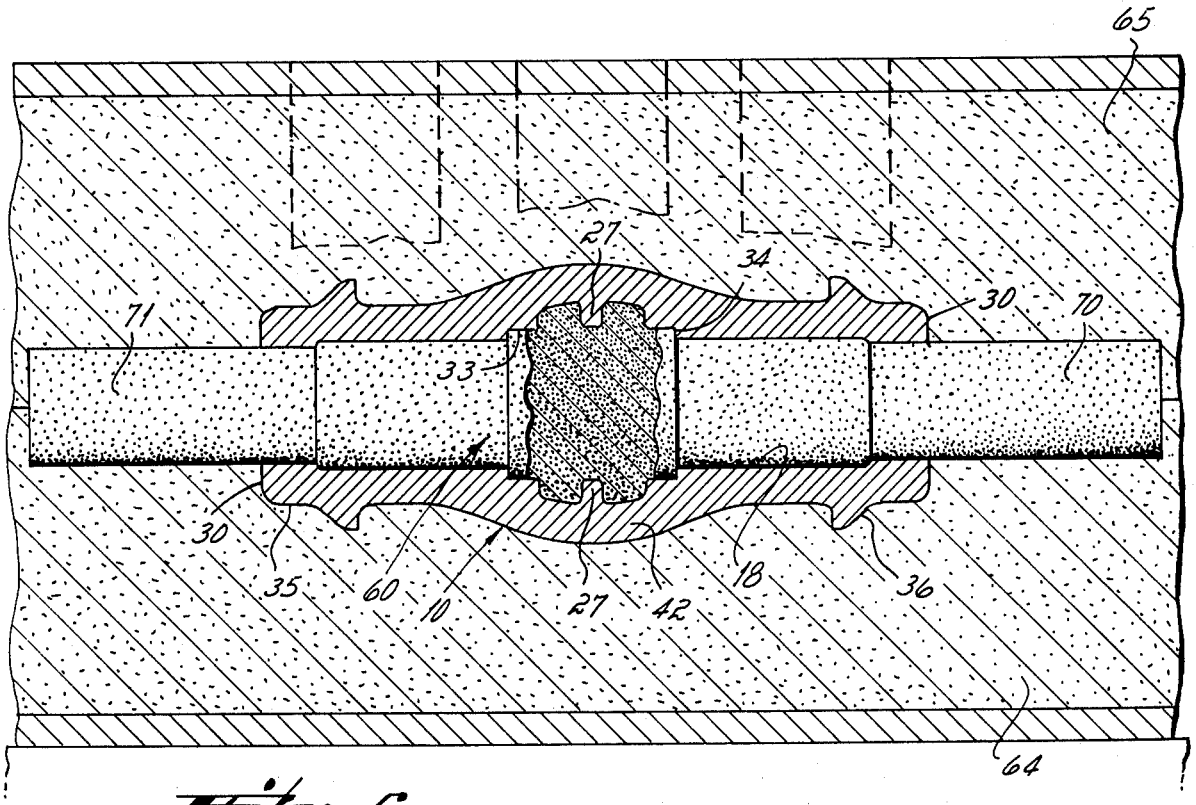
FIG. 5 is a cross-sectional view taken along line 5—5 of FIG. 3.
Figure 6:
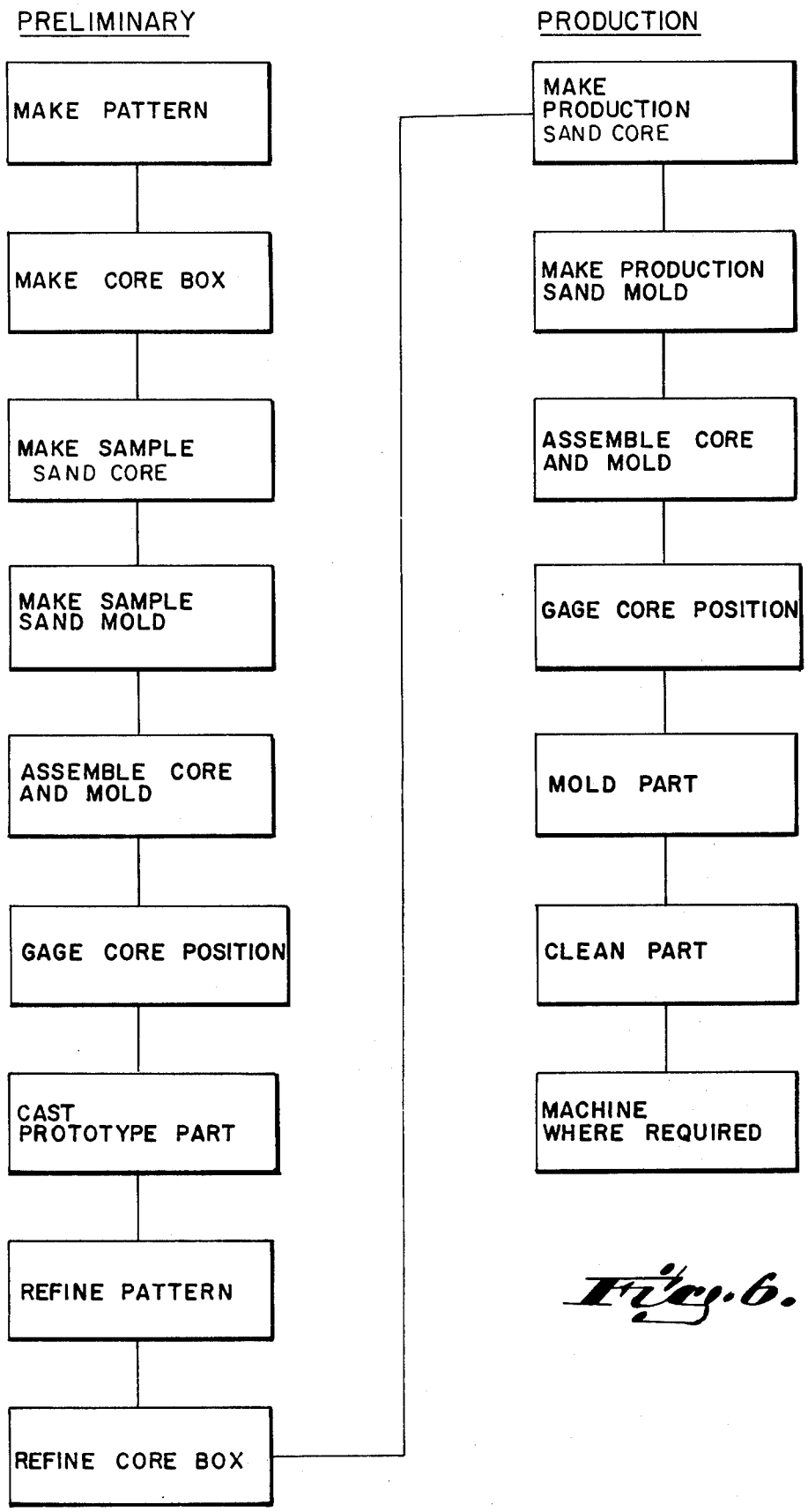
FIG. 6 is a chart showing the preliminary process steps and the production steps in the present precision casting method.

After the mold has been completed, the core 60 is assembled with the mold as shown in FIGS. 3–5. In this regard, it is important that the core prints 70, 71 and 72 fit precisely within the corresponding recesses in the drag portion 64 and cope portion 65 of the mold, for example, a clearance of the order of plus or minus 0.015 inch. Thus, the axis of the core should be closely coincident with the axis of the corresponding mold, i.e., the axis through bore 18.

When the core is in place within the mold, the position of the core is gauged to make certain that the core is located within close tolerances. Thus, the axis of the core must not vary in a direction perpendicular to the axis of the mold by more than 1/32 inch at either end of the core prints 70, 71.

In the next step of the process, a prototype part is cast using precise temperature control. For a part, such as body 10, the pouring temperature is preferably between 2880°–2940° for a steel casting. Obviously, this optimum temperature will vary, as is known to those skilled in the art, depending upon the thickness, configuration and material of the part being cast. After the prototype is cast, it is permitted to cool for a regulated time, such as at least 3½ hours, which insures that the metal is cooled to below 800° F. before the part is removed by hand. Thereafter, the part is subjected to cleaning operations which will not damage the cast surfaces, such as table blasting and grinding of any surface imperfections.

This prototype, when completed, is measured and its dimensions compared with the design dimensions on the part to be produced. If any dimensions of the prototype are inaccurate, or exceed tolerances, the pattern and/or core box are modified or refined by the amount of the deviation in those areas which affect the improper dimension. Thus, if more material is required on the exterior of the finished part, the pattern is built up in that area using suitable material, such as an epoxy. If less material is required on the exterior surface of the finished part, the corresponding area of the pattern is reduced is size. Similarly, if more material is required on the inside of the part, the core box is built up in that area, while if less material is required, that area of the core box is machined to remove the desired amount from the core box.

After the pattern and core box are modified, the parts can be put into production. The first step in the production operation is to make production cores using the same procedures used in making the sample core. These production cores are made from sand of the same quality and characteristics as that previously employed and are produced under the same time and temperature conditions so that each production core produced is reliably held to the same dimensional tolerances.

Production sand molds are prepared, again following precisely the same procedure previously described for making the sample mold and using sand with the same properties, with the production molds being formed with the same time and pressure parameters used in making the sample molds. Thus, production molds are produced having uniform dimensions and properties.

In the next step, the cores are assembled in the molds in the manner described above with the cores being gauged to make certain that they are accurately mounted within the molds. After the molds and cores have been assemnbled and checked, the metal castings are produced. Again, the castings are poured at the same metal temperature previously utilized and the castings are cooled in the mold for at least the same minimum period of time required to cool the casting below 800° F. to prevent distortion.

After the passage of the proper hold time, the castings are carefully removed from the mold. The parts are cleaned by table blasting and if any touchup grinding is necessary, it is carried out. Finally, in order to complete the fabrication of the bodies, those areas, such as surface 31, which require machining are machined.

From the foregoing disclosure of the general principles of the present invention and the detailed description of the manner in which the method is applied in the casting of a specific part, those skilled in the art will readily comprehend the manner in which the present method may be utilized to cast parts of other configurations or sizes.

Thus, by way of example, for core sizes which are too large to be formed in conventional shell core-making equipment, shell cores may be made in sections which are assembled together. Even large cores can be formed in part from a silica bonded sand with high-precision separate core inserts mounted in those areas of the core having critical dimensions. These inserts can be formed of an oil sand baked at approximately 400°. As is well-known to those skilled in the art, these oil sand, baked core inserts provide a hard, dense smooth surface which can be accurately dimensioned. After baking the inserts are placed in the corresponding areas of the core box and are bonded to the remainder of the core using any suitable binding agent.

Accordingly, I desire to be limited only by the scope of the following claims.

I claim:

1. The method of sand casting a part having a smooth flat surface positioned within a predetermined tolerance, said method comprising the steps of:

1. making a pattern incorporating a shrink factor, said pattern being dimensioned to a lesser tolerance than said predetermined tolerance;
2. making a core box, said core box incorporating a shrink factor, said core box being dimensioned to a lesser tolerance than said predetermined tolerance;
3. making a sample core using said core box, said core being made of sand of predetermined characteristics and being made under regulated time and temperature conditions;
4. making a sample mold using said pattern, said mold being made of sand of predetermined characteristics and being made under regulated time and pressure conditions;
5. assembling said sample core within said sand mold and accurately positioning said core, gauging said core to determine that it is properly positioned within said mold;
6. pouring metal into said mold at a predetermined temperature to cast a prototype part and allowing said metal to cool for at least a predetermined time;
7. comparing the dimensions of said prototype part with the desired dimensions thereof;
8. modifying said core box and said pattern in any areas where the dimensions of said prototype part differ from the desired dimensions thereof;
9. producing production sand cores from said modified core box using sand having substantially the same characteristics utilized to produce the sample core and utilizing the same time and temperature conditions;
10. producing production sand molds using said modified pattern, said molds being made from sand having the same characteristics utilized in producing the sample mold and utilizing the same time and pressure conditions;
11. assembling said production cores within said production molds and accurately positioning said cores within said molds, gauging said cores to determine that they are properly positioned to cast a production part;
12. pouring metal into said mold at substantially the same temperature as used to cast the sample part and removing said production part from said mold after said predetermined cooling time.

2. The method of claim 1 in which the predetermined tolerances are of the order of 0.010 inch.

3. The method of claim 1 including the further steps of grinding any portions of the production part requiring touchup and machining one or more surfaces of the said part.

4. The method of claim 1 in which said production parts each include a wall thickness, the thickness of said wall being held within a tolerance of 1/16 inch.

5. The method of claim 1 in which the part is the body of a breech-lock valve and in which there are a plurality of smooth flat surfaces defining inwardly-extending lugs adapted to mate with cooperating lugs on the bonnet of said valve.

6. The method of claim 1 in which said core is a shell core.

* * * * *